US005672836A

United States Patent [19]

Yoshida

[11] Patent Number: 5,672,836

[45] Date of Patent: Sep. 30, 1997

[54] TONE WAVEFORM PRODUCTION METHOD FOR AN ELECTRONIC MUSICAL INSTRUMENT AND A TONE WAVEFORM PRODUCTION APPARATUS

[75] Inventor: Toshiya Yoshida, Shizuoka-ken, Japan

[73] Assignee: Kabushiki Kaisha Kawai Gakki Seisakusho, Japan

[21] Appl. No.: 647,566

[22] Filed: May 14, 1996

[30] Foreign Application Priority Data

May 23, 1995 [JP] Japan ..... 7-146887
May 26, 1995 [JP] Japan ..... 7-151123

[51] Int. Cl.[6] ..... G10H 7/00

[52] U.S. Cl. ..... 84/607

[58] Field of Search ..... 84/604, 607, 629

[56] References Cited

U.S. PATENT DOCUMENTS

| | | | |
|---|---|---|---|
| 5,185,491 | 2/1993 | Izumisawa et al. | 84/627 |
| 5,262,582 | 11/1993 | Hanzawa et al. | 84/607 X |
| 5,416,264 | 5/1995 | Toda et al. | 84/607 X |
| 5,430,241 | 7/1995 | Furuhashi et al. . | |
| 5,466,882 | 11/1995 | Lee | 84/607 X |

*Primary Examiner*—Jonathan Wysocki
*Assistant Examiner*—Jeffrey W. Donels
*Attorney, Agent, or Firm*—Andrus, Sceales, Starke & Sawall

[57] ABSTRACT

A method, for forming a repeated waveform that is employed for an electronic musical instrument, which includes the steps of: setting, as basic data, a loop top address, an initial value of a loop length, and a length change range; changing the loop length within the length change width; forming repeated waveforms that are obtained after cross-fading is performed in consonance with existing conditions; acquiring correlation coefficients of the repeated waveforms, which are obtained by cross-fading, and waveforms at corresponding portions of an original waveform; and selecting a predetermined number of waveforms beginning at a waveform that is most correlative to determine a repeated waveform, and an apparatus therefor. In addition, a method, for forming a waveform that is used for an electronic musical instrument, which includes the steps of: dividing the waveform into band elements for which fluctuation is to be compressed and band elements for which fluctuation is not to be compressed; analyzing, to obtain harmonic elements, the band elements for which the fluctuation is to be compressed; extracting amplitude elements and frequency elements from the harmonic elements that are acquired; compressing fluctuation of the amplitude elements and of the extracted frequency elements; and synthesizing waveform elements that are obtained by analyzing to produce new harmonic elements, and an apparatus therefor.

4 Claims, 8 Drawing Sheets

TONE WAVEFORM PRODUCTION METHOD FOR AN ELECTRONIC MUSICAL INSTRUMENT AND A TONE WAVEFORM PRODUCTION APPARATUS

BACKGROUND OF THE INVENTION

1. Field of the Invention

The present invention relates to a tone waveform production method for producing a tone waveform of high quality by adjusting a phase of a repeated waveform, which is stored in an electronic musical instrument, such as a synthesizer, an electronic piano, an electronic organ or a single keyboard, and which is employed for repeated reading, and by compressing an unnatural fluctuation of the repeated waveform; and to a tone waveform production apparatus.

2. Related Arts

Well known, conventional electronic musical instruments employ tone waveform data reading systems by which tone waveform data, which are stored in advance in waveform memory, are sequentially read and corresponding tone signals are generated to produce musical tones.

With one such tone waveform system, when tone waveform data, which consist of the rising portion and a succeeding repeated portion, that are stored in memory for a tone are read, mainly to save on memory both the tone waveform data for the rising portion and the repeated portion of a musical tone are read once, but thereafter, only the data for the repeated portion are repeatedly read to produce sustained musical signals.

In this system, a well known method for performing a cross-fade of a waveform for a repeated portion (hereinafter referred to as a "loop"), and a waveform for a portion immediately before, is a method by which is formed a waveform for the repeated portion.

With this method, however, if the phases of the waveforms for portions to be cross-faded do not match, when waveform data for the repeated portion are repeatedly read the flow of produced musical tones sounds unnatural, and unnecessary high harmonic tones occur. Furthermore, as unnatural beats are generated, frequently the quality of musical tones is drastically degraded.

To resolve the above shortcomings, conventionally, an operator searches for a point (an optimal loop length) for a cross-fade by observing a waveform or by listening to musical tones. Therefore, it takes time to acquire the point, and since phase adjustment is a very delicate process, phase matching is difficult; in some cases the phases can not be satisfactorily matched.

There is an increasing demand for a method by which to easily produce a waveform having a high quality for a repeated portion for which the phase has been matched.

When the amplitude element and the frequency element of the waveform that is obtained by cross-fading in the above system fluctuate greatly, the musical tones that are produced may be heard as a loop that is accompanied by unnatural fluctuation.

Generally, a waveform that is produced only by cross-fading is accompanied by unnatural fluctuation and provides rough tones.

Therefore, there is a demand for a method and an apparatus, by which to acquire a repeated waveform having a high quality, that can easily compress the fluctuation of a repeated waveform.

SUMMARY OF THE INVENTION

It is, therefore, a first object of the present invention to provide a method, for forming a repeated waveform, by which a repeated waveform having a high quality can be immediately and easily produced, and to provide an apparatus therefor.

It is a second object of the present invention to provide a method and an apparatus for producing a waveform having a high quality for which unnatural fluctuation is compressed.

To achieve the above objects, according to a first aspect of the present invention, a method for forming a repeated waveform that is employed for an electronic musical instrument comprises the steps of:

setting, as basic data, a loop top address, an initial value of a loop length, and a length change range;

changing the loop length within the length change range;

forming repeated waveforms that are obtained after cross-fading is performed in consonance with existing conditions;

acquiring correlation coefficients of the repeated waveforms, which are obtained by cross-fading, and waveforms at corresponding portions of an original waveform; and selecting a predetermined number of waveforms beginning at a waveform that is most correlative to determine a repeated waveform.

According to the first aspect of the present invention, an apparatus for forming a repeated waveform comprises:

an address calculator for calculating addresses of repeated waveforms that are produced in consonance with a change in a length;

a loop processor for forming repeated waveforms obtained after cross-fading in consonance with an output of the address calculator;

a correlation coefficient calculator for calculating correlation coefficients for the repeated waveforms, which are produced by the loop processor, and waveforms at corresponding portions of an original waveform;

a peak detector for detecting a peak of the correlation coefficients that are obtained by the correlation coefficient calculator;

a selector for employing an output from the peak detector to select a predetermined number of waveforms beginning at that waveform that is most correlative; and a display device for displaying a result of a selection by the selector.

According to a second aspect of the present invention, a method for forming a waveform that is used for an electronic musical instrument comprises the steps of:

dividing the waveform into band elements for which fluctuation is to be compressed and band elements for which fluctuation is not to be compressed;

analyzing, to obtain harmonic elements, the band elements for which the fluctuation is to be compressed;

extracting amplitude elements and frequency elements from the harmonic elements that are acquired;

compressing fluctuation of the amplitude elements and of the frequency elements that are extracted; and synthesizing waveform elements that are obtained by analyzing to produce new harmonic elements.

According to the second aspect of the present invention, an apparatus for forming a waveform that is used for an electronic musical instrument comprises:

band element dividers for dividing the waveform into band elements for which fluctuation is to be compressed and band elements for which fluctuation is not to be compressed, and for analyzing, to obtain harmonic elements, the band elements for which the fluctuation is to be compressed;

amplitude element extractors for extracting amplitude elements from the harmonic elements that are acquired by the band element dividers;

frequency element extractors for extracting frequency elements from the harmonic elements that are acquired by the band element dividers;

amplitude element fluctuation compressors for compressing fluctuation of the amplitude elements that are extracted by the amplitude element extractors;

frequency element fluctuation compressors for compressing fluctuations of the frequency elements that are extracted by the frequency element extractors;

harmonic element synthesizers for synthesizing outputs of the amplitude element fluctuation compressors and outputs of the frequency element fluctuation compressors to produce new harmonic elements; and a band element adder for adding the new harmonic elements that are obtained by the harmonic element synthesizers to the band elements that remain unchanged.

With the thus arranged components of the present invention, when a general-purpose computer or a sampler of a synthesizer is employed to produce a repeated waveform after cross-fading, a loop top address, an initial value of a loop length, and a length change range are provided, and the loop length of a waveform that is to be cross-faded is automatically and sequentially changed within the range of a change in the length, so that the repeated waveforms that are consonant with individual loop lengths are produced.

Then, correlation coefficients of the individual repeated waveforms and the corresponding portions of an original waveform are acquired, and waveforms in a predetermined number are selected, beginning with the repeated waveform that is most correlative, so that a repeated waveform is determined.

As a result, a cross-faded loop that is similar to the original waveform is obtained, the flow of produced musical tones is natural, the occurrence of unnecessary higher harmonic tones can be prevented, and musical tones of a high quality are thus acquired.

Further, according to the present invention, since a repeated waveform is produced automatically, the operation is easy and certain, and only a short time is required for the waveform production.

In addition, in the present invention, a general-purpose computer, etc., are used to compress an unnatural fluctuation that is caused by, for example, a repeated waveform that is obtained by cross-fading. A tone waveform for which compression of a fluctuation is desired is divided into band elements, for which fluctuation is to be compressed, and band elements, for which fluctuation is not to be compressed. The band elements for which fluctuation is to be compressed are divided into individual harmonic tones, which are then analyzed to acquire amplitude elements and frequency elements. The fluctuation is compressed for each element of the two sets of elements, and the resultant elements are synthesized.

As a result, provided is a natural, reproduced waveform for which only the fluctuation is compressed while the tone level is unchanged. In addition, as the compression of the fluctuation can be automatically performed, the operation is easy, and only a short time is required for the waveform production.

Furthermore, according to the present invention, the fluctuation of a musical tone can be controlled as desired by adjusting the compression rate at which fluctuation for each element is compressed.

DETAILED DESCRIPTION OF THE PREFERRED EMBODIMENTS

Figure 1:
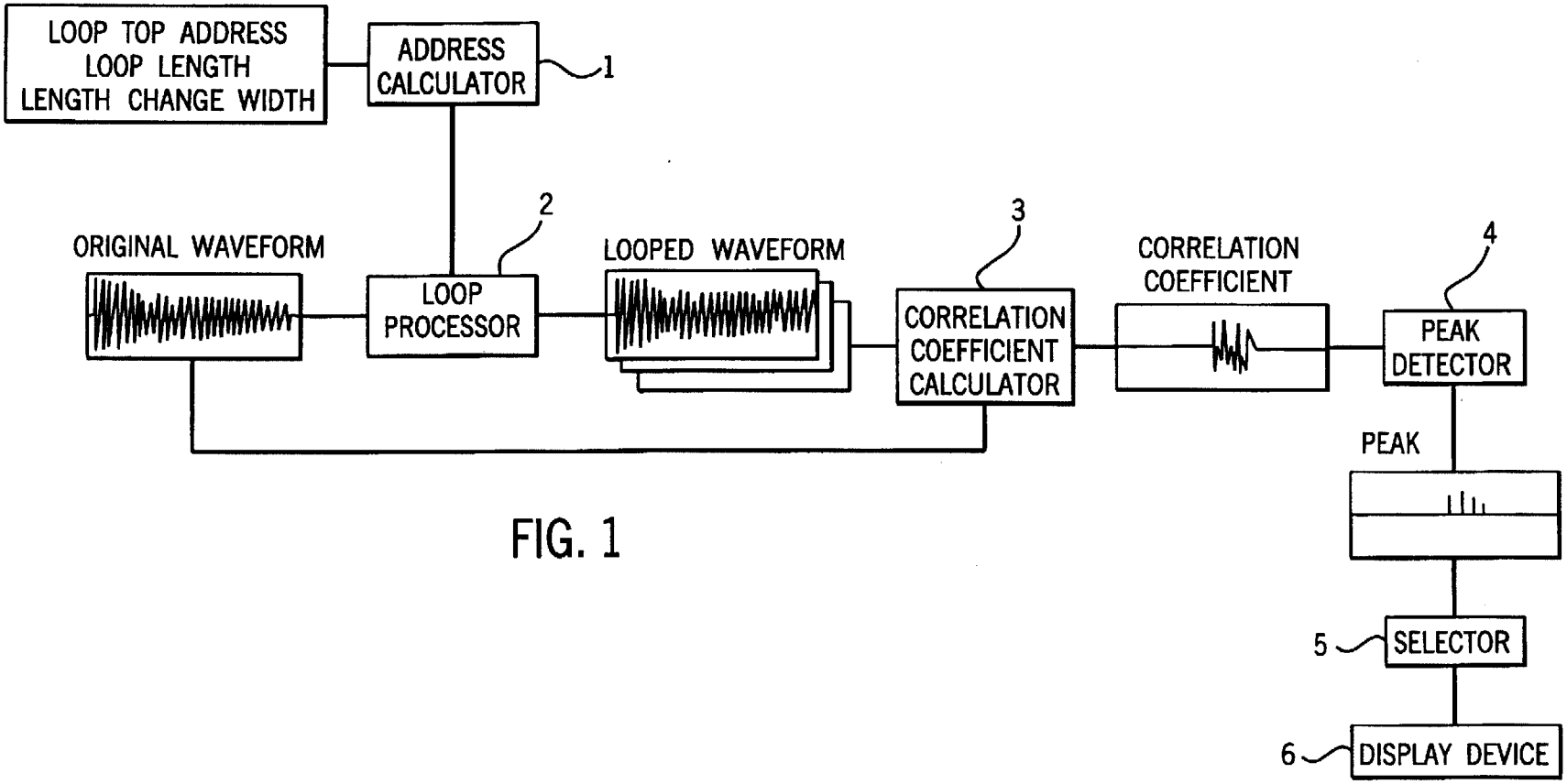
FIG. 1 is a schematic block diagram illustrating a first apparatus for producing a repeated waveform according to the present invention.

FIG. 1 is a schematic block diagram illustrating a first apparatus for forming a repeated waveform according to the present invention.

As is shown, the first apparatus for forming a repeated waveform of the present invention comprises an address calculator 1; a loop processor 2; a correlation coefficient calculator 3; a peak detector 4; a selector 5; and a display device 6.

With this arrangement, when an operator inputs a loop top address, an initial value of a loop length, and a range for a change in a loop length for simulation, these input values are read by the address calculator 1. The address calculator 1 employs these values to sequentially calculate addresses for an original waveform that is to be cross-faded to acquire a repeated waveform, and transmits the addresses to the loop processor 2.

The range of a length change specifies a range for a loop length that is to be simulated. Within the range of the length change, a computer automatically changes a loop length and calculates addresses, and transmits the results to the loop processor 2.

Upon receipt of the original waveform, the loop processor 2, after cross-fading, employs data that were transmitted by the address calculator 1 to acquire resultant waveforms, each of which corresponds to a loop length, and sends the resultant waveforms to the correlation coefficient calculator 3.

The correlation coefficient calculator 3 calculates correlation coefficients for the repeated waveforms that are produced by the loop processor 2 and the corresponding portions of the original waveform.

The correlation coefficient that is obtained by the correlation coefficient calculator 3 is represented by the following expression, wherein {Xn} denotes a data series for an original waveform and {Yn} denotes a data series for a cross-fade loop.

$$r(L)=\frac{1}{L\cdot\sigma_x\cdot\sigma_y}\sum_{n-m}^{m+L-1}XnYn$$

wherein m: loop top address

L: loop length $\sigma_x$: standard deviation of $X_m$ to $X_{m+L-1}$ $\sigma_y$: standard deviation of $Y_m$ to $Y_{m+L-1}$.

The peak detector 4 compares the correlation coefficients for individual waveforms that are transmitted from the correlation coefficient calculator 3 to obtain a peak value (the maximum point), and sends the result to the selector 5.

Upon receipt of the peak value from the peak detector 4, the selector 5 selects a predetermined number of repeated waveforms in order, beginning with the repeated waveform that is the most correlative. The results of the selection process are transmitted to the display device 6.

Therefore, while an operator is looking at the results displayed on the display device 6, he or she can select a preferable repeated waveform.

It should be noted that the predetermined number is used to specify the repeated waveforms that are to be produced, and is set in advance by the operator.

With this arrangement of the present invention, when an operator enters setup conditions for repeated waveforms, a computer or a sampler automatically prepares a predetermined number of repeated waveforms in order, beginning with the most correlative waveform.

According to the present invention, therefore, the production of repeated waveforms is rapid and easy, and a natural, repeated waveform of a high quality can be provided.

When a general-purpose computer, for example, is employed to produce a repeated waveform in the present invention, the functions of the address calculator 1, the loop processor 2, the correlative coefficient calculator 3, the peak detector 4 and the selector 5 can be accomplished by a software program.

Figure 2:
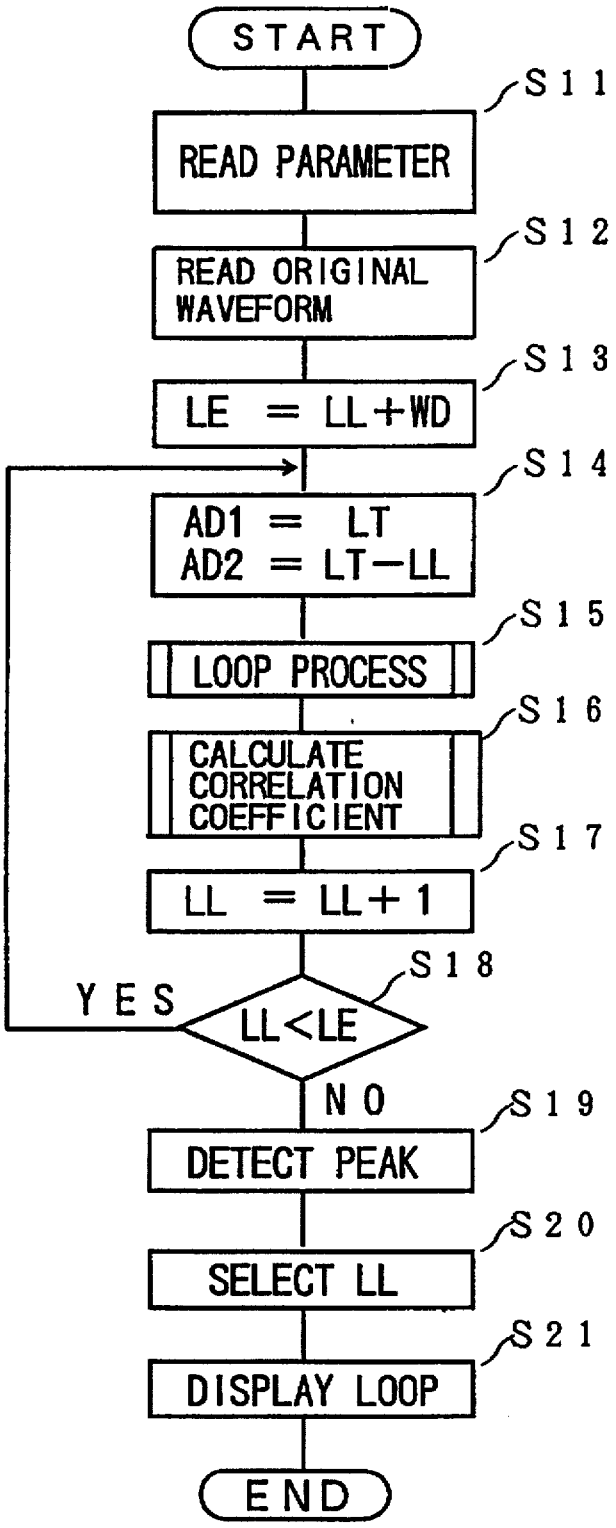
FIG. 2 is a main flowchart for explaining the processing by the first apparatus for producing a repeated waveform according to the present invention.

FIG. 2 is a main flowchart for explaining the processing performed by a repeated waveform production apparatus according to the present invention. The processing for this embodiment will be described while referring to the flowchart.

First, a parameter is read (step S11). In this process, a loop top address (LT), an initial value of a loop length (LL), and a length change width (WD), all of which are input by an operator, are fetched by the address calculator 1.

Then, an original waveform is read by the loop processor 2(Step S12), and a loop length that indicates the end condition (LE) for simulation is set (step S13). The end condition LE for simulation is acquired by adding the initial value of the loop length LL to the length change width WD.

Sequentially, data, from the address calculator 1, that are used for calculation of a cross-faded waveform are set (step S14). In other words, a loop top address LT for each waveform to be cross-faded is set in variable AD1, and a difference, LT−LL, between the loop top address LT and the initial value of the loop length LL is set to variable AD2.

The loop processor 2 performs a loop process in consonance with the above setting (step S15). During the loop process, a cross-faded waveform is produced in consonance with the initial value that is set at step S14. This processing will be described in detail while referring to FIG. 3.

Following this, the correlation coefficient calculator 3 calculates a correlation coefficient for each of the waveforms obtained after cross-fading, and an original waveform (step S16). The acquired results are sent to the peak detector 4 and stored therein. The calculation of the correlation coefficient will be described in detail in a sub-routine for a correlation coefficient calculation process in FIG. 4.

The loop length LL is incremented by one for the succeeding simulation (step S17). A check is then performed to determine whether or not simulation should be continued (step S18). During this processing, the loop length LL that was set at step S17 is examined to determine whether or not its value equals that of the end condition LE for simulation, which was set at step S13.

When, at step S18, the value of the loop length LL does not yet equal that of the end condition LE, program control returns to step S14, and simulation is repeated with the succeeding loop length that was obtained by incrementing at step S17.

When, at step S18, the value of the loop length LL equals that of the end condition LE, i.e., when the simulation is completed for all the loop lengths, the peak detector 4 compares the results of simulations for all the waveforms, and detects a peak (the maximum point) (step S19).

From among the waveforms that are detected and stored by the peak detector 4, the selector 5 selects a predetermined number of waveforms, beginning with the most correlative waveform (step S20). The predetermined number of selected waveforms are transmitted to the display device 6, and are displayed on the display device 6 (step S21).

An operator can select and determine an arbitrary repeated waveform to be used while looking at the results on the display device 6.

As is described above, according to the present invention, while given initial value is employed as initial condition, correlation coefficients between produced waveforms and an original waveform are automatically simulated within the range of the length change width WD, and an optimal repeated waveform can be selected.

Thus, a highly accurate repeated waveform can be automatically prepared.

Figure 3:
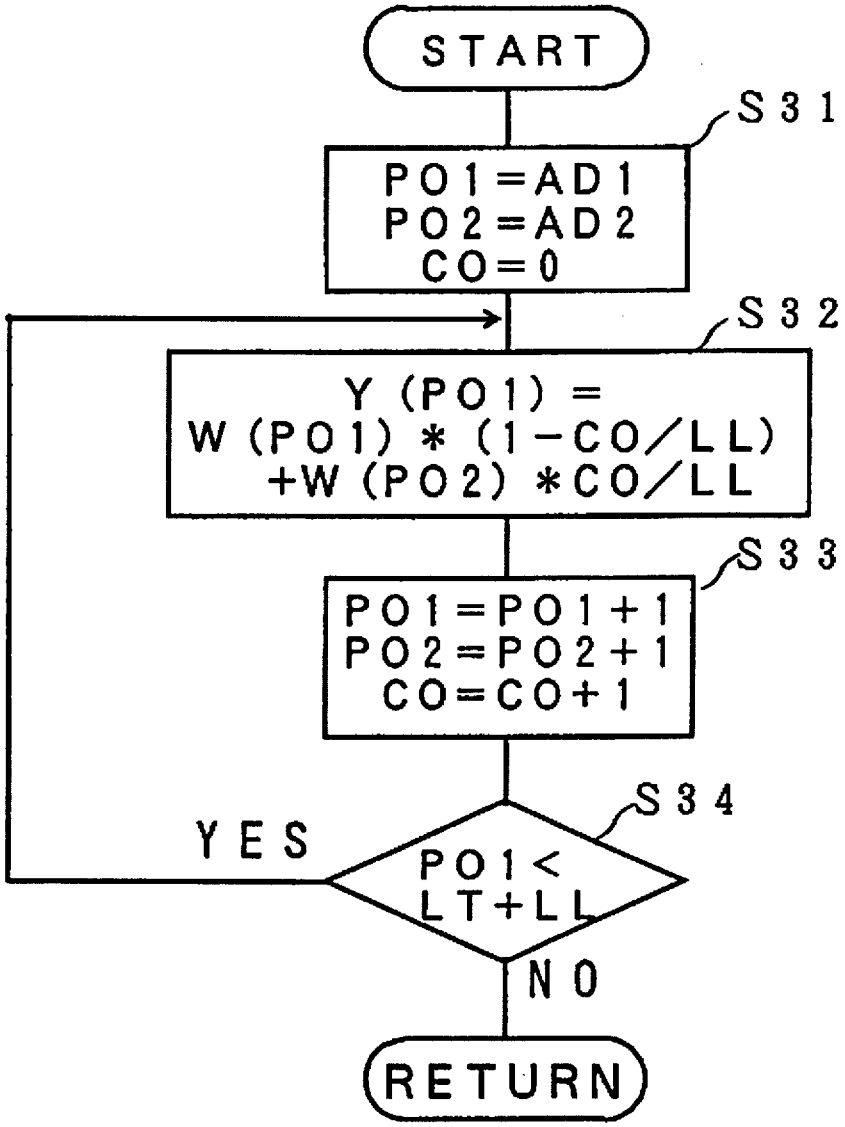
FIG. 3 is a flowchart for explaining a loop process for the first apparatus for producing a waveform according to the present invention.

The processing performed by the loop processor 2 of the present invention for producing repeated waveforms will now be described while referring to FIG. 3.

In the loop process, first, initial values are set (step S31). In the initial value setup, head addresses for two waveforms, AD1 and AD2, are set in variables PO1 and PO2 for employment in the preparation of cross-faded waveforms. "0" is set to a counter CO.

Then, amplitude values at sampling points for two waveforms to be cross-faded are employed to acquire, at the sampling point for the waveform obtained after cross-fading is performed (step S32), an amplitude value Y (PO1).

The sampling points PO1 and PO2 for the two waveforms to be cross-faded, and a value held by the counter CO are incremented by one (step S33).

Sequentially, a check is performed to determine whether or not the sampling points obtained by incrementing fall within the range of the loop lengths of the waveforms to be cross-faded (step S34). When the sampling points are within the range, program control returns to step S32, and calculation of an amplitude is repeated, at a sampling point, for a succeeding waveform obtained by cross-fading.

When the sampling points are outside the range, the acquisition of a cross-faded waveform from the above waveforms is terminated, and program control returns to step S16 in the main routine.

In this manner, according to the present invention, while a loop length is altered within the length change width WD, a waveform is produced by cross-fading, and a coefficient of the waveform and the original waveform is calculated to examine their correlation.

At step S32 in this embodiment, an expression for linear cross-fading is employed, but a logarithm, exponential function, a sine curve, or a cosine curve may be used as a cross-fading method.

Figure 4:
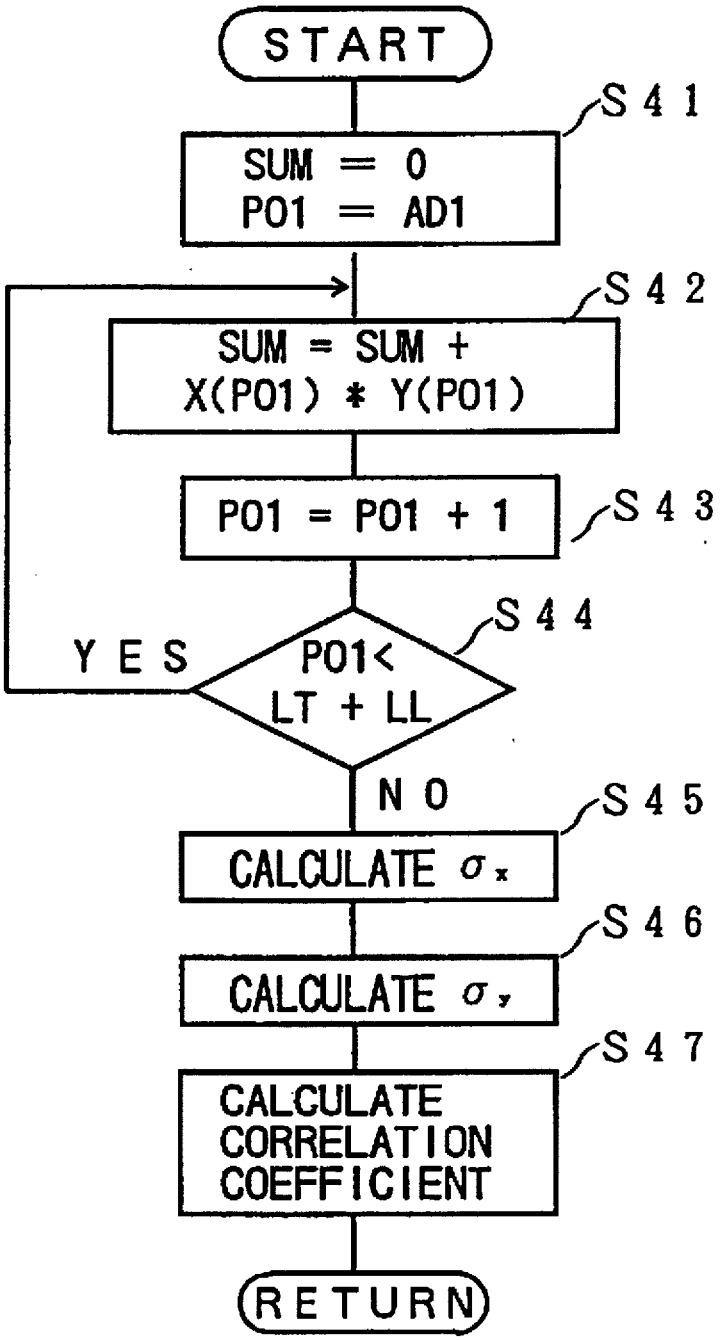
FIG. 4 is a flowchart for explaining a process for the calculation of a correlation coefficient of the first apparatus for producing a waveform according to the present invention.

FIG. 4 is a flowchart for explaining the sub-routine for the correlation coefficient calculation at step S16 in the main flowchart. The processing for the correlation coefficient calculation will be described while referring to FIG. 4.

For the calculation of a correlation coefficient, first, initial values are set (step S41). At the initial value setup, "0" is set to a variable SUM to which an accumulated value is input, and loop top addresses (AD1), which indicate loop tops of the original waveform and a waveform obtained by cross-fading, are set to PO1.

Then, SUM=SUM+X(PO1)*Y(PO1) is calculated (step S42). X(PO1) denotes an amplitude value of the original waveform and Y(PO1) denotes an amplitude value for a waveform obtained by cross-fading.

The value of the sampling point PO1 that is used to acquire a waveform by cross-fading is incremented by one (step S43).

Sequentially, a check is performed to determine whether or not PO1<LT+LL (step S44). During this processing, the resultant sampling point obtained by incrementing is examined to determine whether it falls within the range of the loop length for a waveform to be produced.

When the value of the sampling point PO1 has not yet reached that of a loop end address, program control returns to step S42 and the same processing is repeated for a succeeding data value.

When the value PO1 exceeds the loop end address value, the extraction of a sampling point for the waveform is completed. Program control thus advances to the following step to acquire X and Y standard deviations, $\sigma_x$ and $\sigma_y$ (steps S45 and S46). The standard deviations $\sigma_x$ and $\sigma_y$ are acquired because the waveforms having different loop lengths are normalized so as to enable a comparison of them to be made.

Then, at step S47, a correlative coefficient is calculated by using the standard divisions $\sigma_x$ and $\sigma_y$ and by the expression given above:

$$r(L)=\frac{1}{L\cdot\sigma_x\cdot\sigma_y}\sum_{n-m}^{m+L-1}XnYn$$

When the above described calculation of the correlation coefficient of the waveform obtained by sampling is completed, program control returns to the main routine. The calculation of a correlative coefficient for a succeeding waveform obtained by sampling is repeated.

A second tone waveform production apparatus for compressing unnatural fluctuation according to the present invention will now be described while referring to the accompanying drawings.

Figure 5:
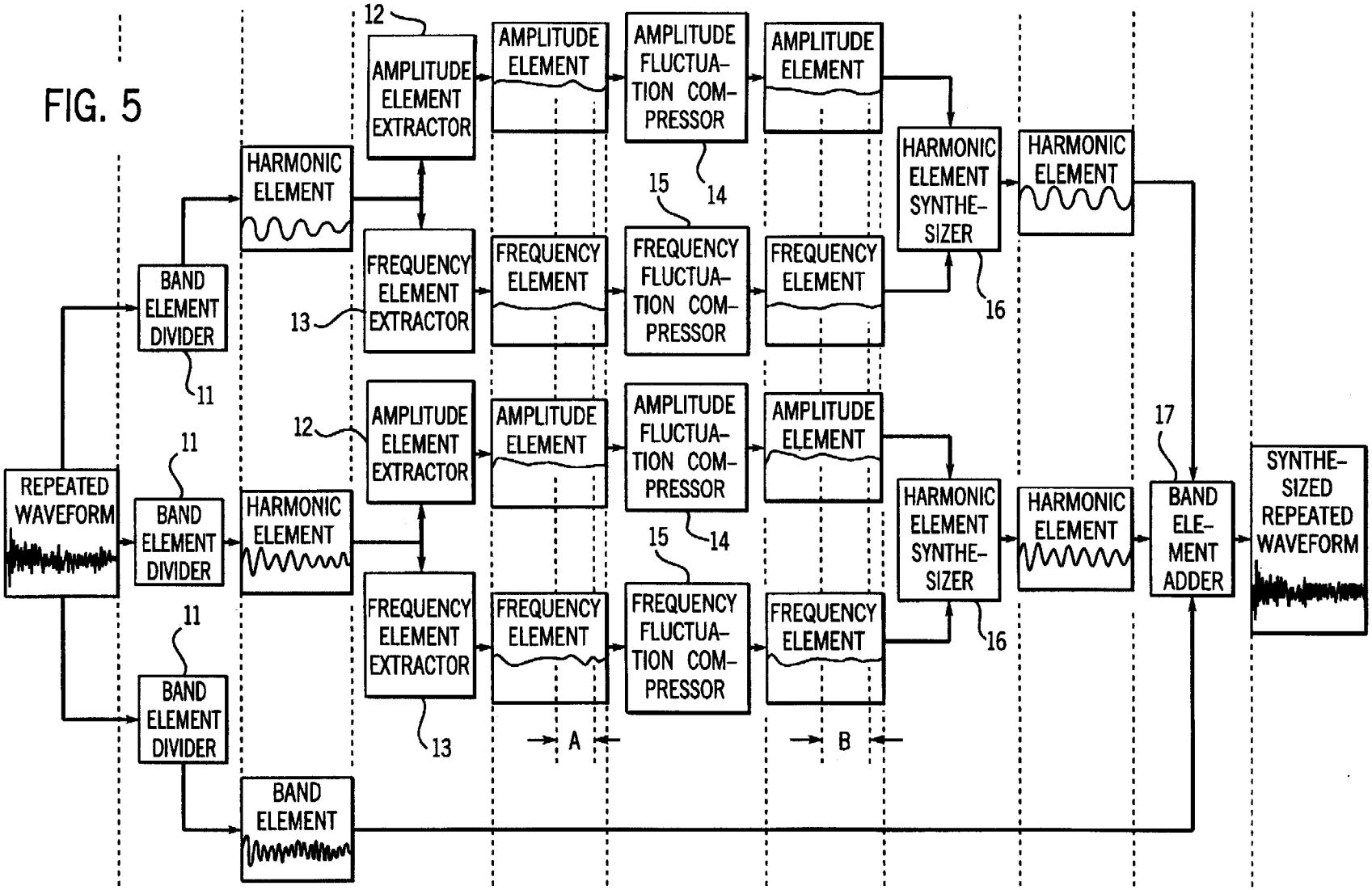
FIG. 5 is a schematic block diagram illustrating a second apparatus for producing a repeated waveform according to the present invention.

FIG. 5 is a schematic functional block diagram illustrating the arrangement of the second tone waveform production apparatus according to the present invention. In this embodiment, a repeated waveform, obtained by cross-fading, in which unnatural fluctuation tends to occur is used as an input waveform.

As is shown in FIG. 5, the second tone waveform production apparatus according to the present invention comprises: band element dividers 11; amplitude element extractors 12; frequency element extractors 13; amplitude element fluctuation compressors 14; frequency fluctuation compressors 15; harmonic element synthesizers 16; and a band element adder 17.

With this arrangement, a repeated waveform produced by cross-fading is, for example, divided by the band element dividers 11 into band elements for which fluctuations are to be compressed, and band elements for which compression of a fluctuation is not necessary.

Generally, fluctuations in a band that is close to the audible limit and in a low-level band are not very noticeable, but a fluctuation in a band close to fundamental tones or in a high level band is noticeable. During this processing, such a band element is removed.

Then, the band element for which the fluctuation is to be compressed is divided for individual harmonic tone elements. From the obtained harmonic tone elements, their amplitude elements (envelopes) and frequency elements (pitches) are extracted by the amplitude element extractors 12 and the frequency element extractors 13 that are provided for the respective harmonic tone elements.

The fluctuations of the extracted amplitude elements and frequency elements are compressed for each element by corresponding compressors, i.e., the amplitude element fluctuation compressors 14 and the frequency element fluctuation compressors 15.

During the compression processing by each of the amplitude element fluctuation compressors 14, an average value for the amplitude element of the repeated waveform is calculated, and a difference between the waveform and the average value is compressed at an arbitrary compression rate, i.e., 0.5. As a result, a new amplitude element is acquired, for which the fluctuation is compressed by half while the average value is maintained unchanged.

In the same manner, each of the frequency element fluctuation compressors 15 calculates an average value for the frequency element of the waveform at the repeated portion, and compresses a difference between the waveform and the average value at an arbitrary compression rate. As a result, a new frequency element is acquired for which fluctuation is compressed while the average value is maintained the same.

The new amplitude elements and the frequency elements that are thus obtained by each harmonic element are synthesized by one of the harmonic element synthesizers 16.

Then, the band element adder 17 adds the resultant individual harmonic elements to the original band element for which fluctuation is not compressed, and produces a new synthesized waveform.

As a result, since a waveform is acquired for which differences between it and the average values of the amplitude and the frequency are compressed while the average values are maintained unchanged, unnatural fluctuation is removed.

Therefore, when the present invention is applied to a repeated waveform that is formed by cross-fading, a natural, repeated waveform from which unnatural fluctuation is removed can be provided.

Figure 6:
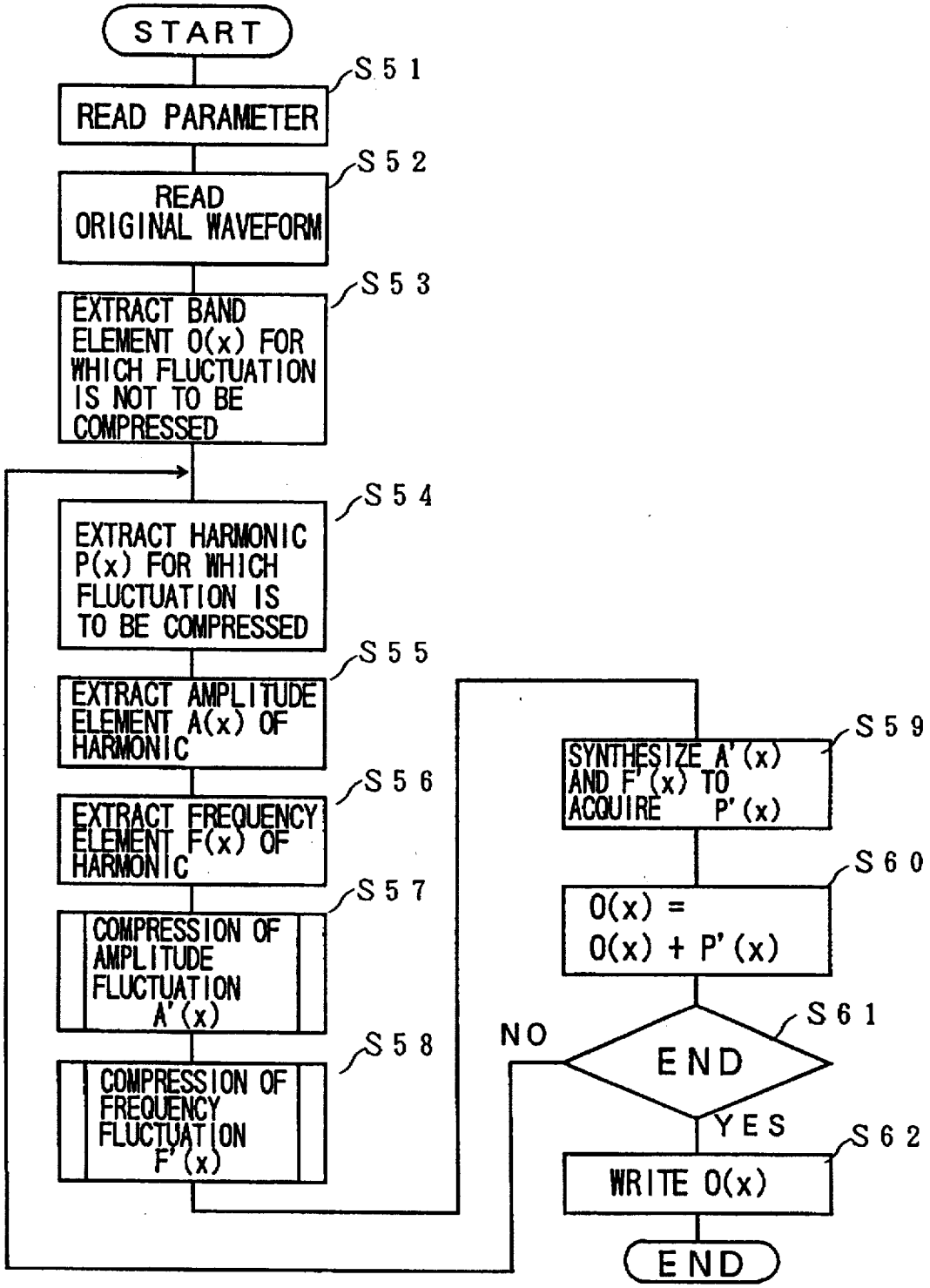
FIG. 6 is a main flowchart for explaining the processing of the second apparatus for producing a repeated waveform according to the present invention.

FIG. 6 is a main flowchart for explaining the entire operation of the second tone waveform production apparatus according to the present invention. The entire operation of the apparatus will now be described while referring to FIG. 6.

First, parameters are input to the apparatus by an operator (step S51). The input parameters are a compression start address a for a repeated waveform; loop top address b; loop length LL; compression rate ra for amplitude element fluctuation; and compression rate rb for frequency element fluctuation. Loop end address c is acquired by calculating c=b+LL.

When an original waveform is read (step S52), each of the band element dividers 11 divides a repeated waveform into band elements, for which fluctuation is to be compressed, and band elements for which fluctuation need not be compressed and that remain unchanged, and extracts the band element for which fluctuation compression is not necessary (step S53).

Further, the band element divider 11 divides the band elements for which fluctuation is to be compressed into individual harmonic tone elements and extracts them (step S54).

From the harmonic tone elements obtained by division at step S54, the amplitude element extractor 12 that is provided for each harmonic tone extracts the amplitude elements (step S55).

And from the harmonic tone elements, the frequency element extractor 13 that is provided for each harmonic tone extracts the frequency elements (step S56).

Sequentially, each of the amplitude element fluctuation compressors 14 compresses the amplitudes that are extracted for the respective harmonic tones (step S57). In other words, the average value of the amplitude elements of the repeated portion is acquired, and the difference between the waveform and the average value is compressed at an arbitrary compression rate.

As a result, while the average value is maintained unchanged, new amplitude elements for which fluctuation is compressed are acquired. The processing of the amplitude element fluctuation compressor 14 will be described in detail later while referring to FIG. 7.

Each of the frequency element fluctuation compressors 15 compresses the frequencies that are extracted for the respective harmonic tones (step S58). In other words, the average value for the frequency elements of the repeated portion is acquired, and the difference between the waveform and the average value of the frequency elements is compressed at an arbitrary compression rate.

As a result, while the average value is maintained unchanged, new frequency elements for which fluctuation is compressed are acquired. The processing by the frequency element fluctuation compressor 14 will be described in detail later while referring to FIG. 8.

Following this, each of the harmonic tone element synthesizers 16 synthesizes one of the new amplitude elements A'(x) and one of the new frequency element F'(x), which were obtained at steps S57 and 58 by compressing the fluctuations for each harmonic tone, and produces a harmonic element P'(x) (step S59).

The band element adder 17 adds the harmonic elements P'(x), which are provided for each harmonic tone by the harmonic tone element synthesizers 16, to band element O(x), which was extracted at step S53 and for which fluctuation compression is not required (step S60).

A check is then performed to determine whether or not the elements of all the waveforms have been synthesized (step S61). When the synthesizing has not been completed, program control returns to step S54, and non-synthesized elements are synthesized.

When all the elements have been synthesized, a resultant waveform is written (step S62), and the fluctuation compression process is thereafter terminated.

The fluctuation compression of the present invention is performed in the above described manner. When compression rates that differ for each amplitude element and each frequency element are employed for the compression of the fluctuations of these elements at steps 57 and 58, an operator can control the fluctuation as desired.

Figure 7:
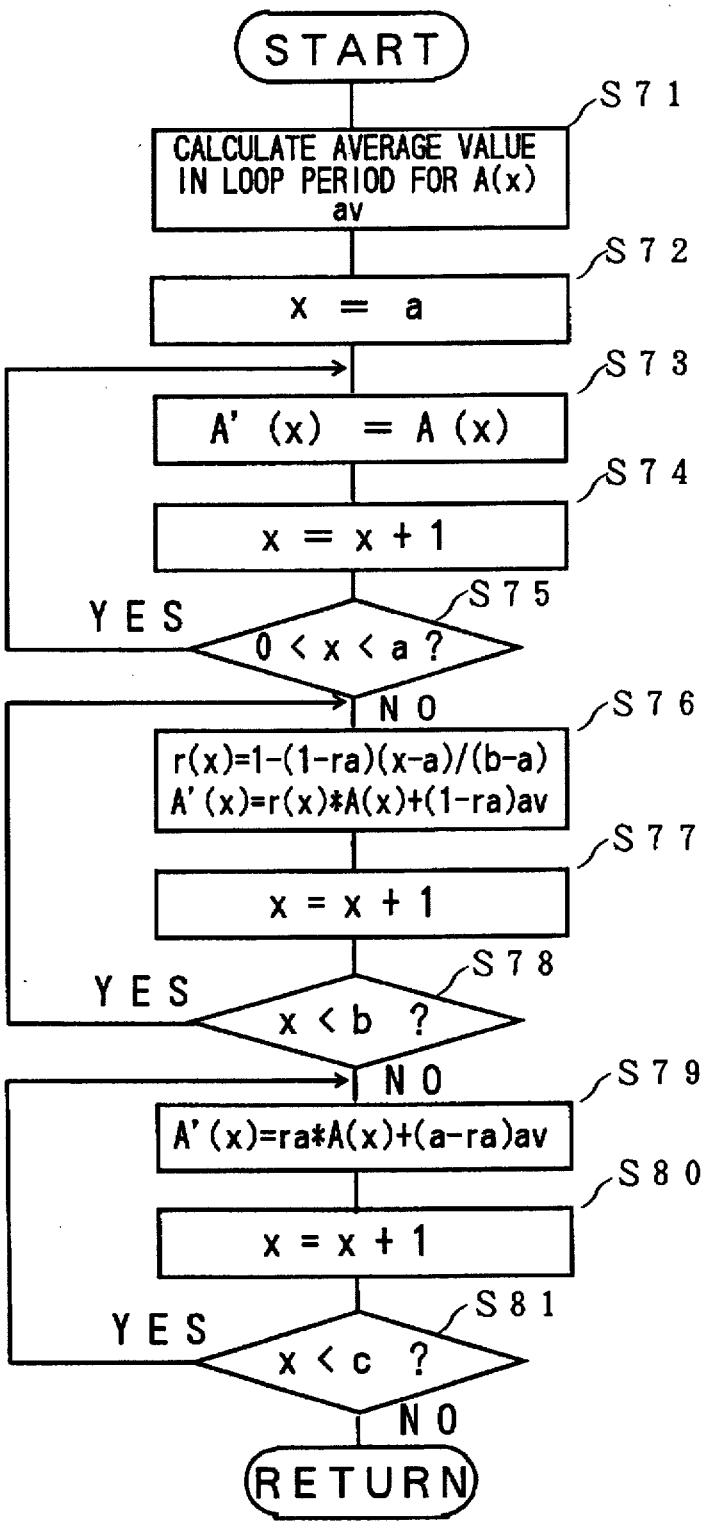
FIG. 7 is a flowchart for explaining a process performed by an amplitude element fluctuation compressor of the second apparatus for producing a waveform according to the present invention.

The compression process performed by the amplitude element fluctuation compressors 14 will be explained while referring to FIG. 7.

In this process, first, average amplitude value av is calculated within a loop interval of a pertinent repeated waveform (step S71), and compression start address a is set to variable x (step S72).

Then, amplitude fluctuation A(x) of the original waveform is set as compressed amplitude fluctuation variable A'(x) (step S73). Variable x indicating the position of a sampling point is incremented by one (step S74). A check is then performed to determine whether or not the variable x falls within $0<x<a$ (step S75).

In the processing at steps S73 through S75, a check is performed to determine whether or not the sampling point x has reached compression start point a. When x has not reached the compression start point a, compression of fluctuation is not required. Thus, the amplitude fluctuation A(x) is set unchanged to the compressed amplitude fluctuation variable A'(x).

When, at step S75, the variable x has not reached the compression start point a, compression is not required, program control returns to step S73 and the same processing is repeated.

When the variable x incremented at step S75 has reached the compression start point a, the compression rate r(x) at the position of the variable x is calculated, and the compressed fluctuation A'(x) is calculated at the resultant compression rate r(x) (step S76).

In this calculation, the compression rate is gradually changed so that the compression rate is 1.0 at the compression start point a and becomes a predetermined compression rate ra at the loop top b.

Sequentially, the value of the sampling point x is incremented (step S77), and a check is performed to determine whether or not for the resultant sampling point x the relation $x<b$ is true (step S78).

If $x<b$, the sampling point x has not reached the loop top and the compression rate should be gradually changed. Program control returns to step S76, and the above processing is repeated.

If $x \geqq b$, the sampling point x has reached the loop top, and fluctuation to the loop end is compressed at the predetermined compression rate ra (step S79).

The sampling point x is incremented (step S80), and a check is performed to determine whether or not the resultant point x is located within the loop top and the loop end ($x<c$) (step S81).

When the sampling point x has not yet reached the loop end, the compression must be continued. Program control therefore returns to step S79, and the above processing is repeated.

If the sampling point x has reached the loop end, the compression for fluctuation in a predetermined loop is completed. Program control thereafter returns to the main routine.

In this manner, a natural waveform can be obtained for which an amplitude fluctuation compression rate is moderately changed from the compression start point a to the loop top b.

Figure 8:
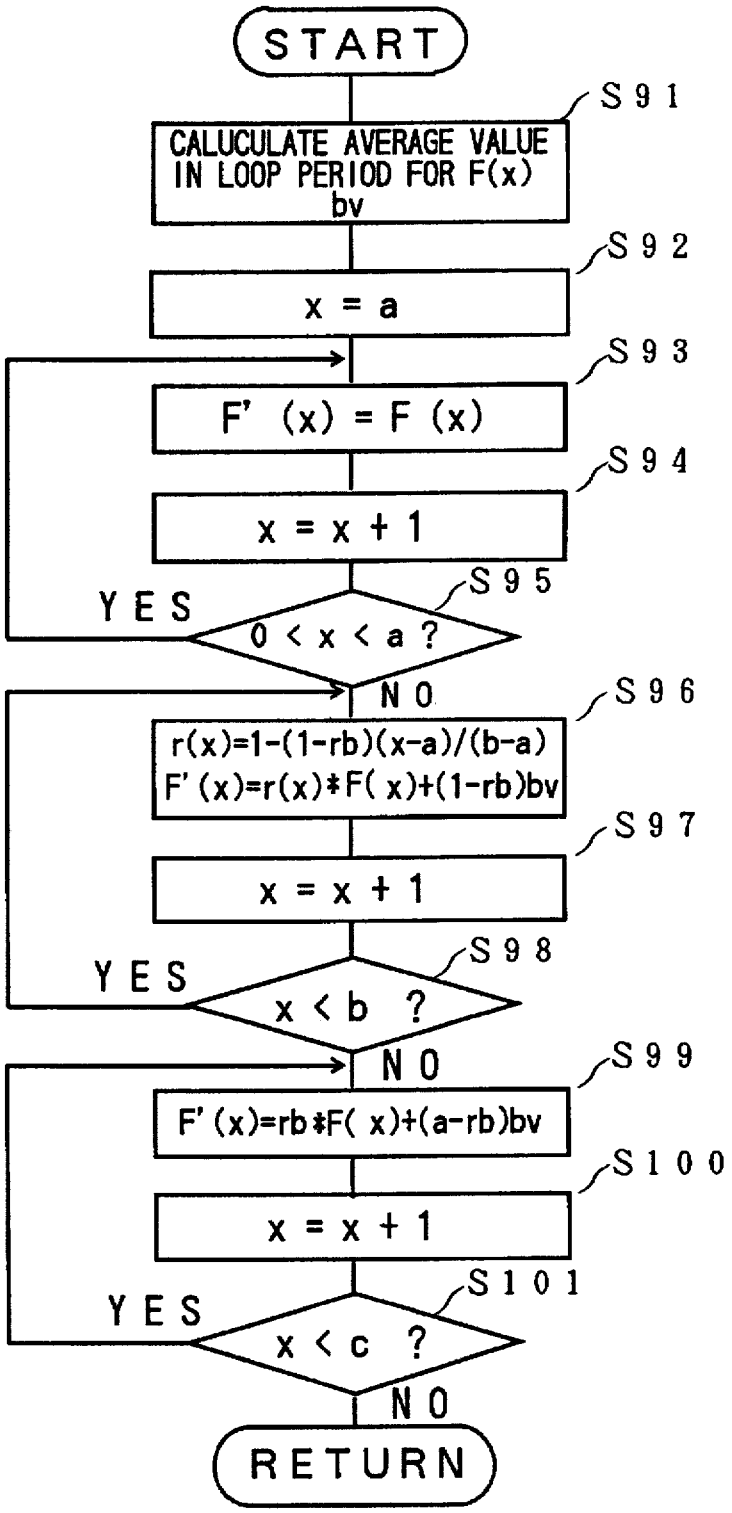
FIG. 8 is a flowchart for explaining a process performed by a frequency element fluctuation compressor of the second apparatus for producing a waveform according to the present invention.

FIG. 8 is a flowchart for explaining the processing of the frequency element fluctuation compressors 15. The compression process performed by the frequency element fluctuation compressors 15 will be explained while referring to FIG. 8.

In this process, first, average frequency value bv is calculated within a loop interval of a pertinent repeated waveform (step S91), and compression start address a is set to variable x (step S92).

Then, frequency fluctuation F(x) of the original waveform is set as compressed frequency fluctuation variable F'(x) (step S93). Variable x indicating the position of a sampling point is incremented by one (step S94). A check is then performed to determine whether or not the variable x falls within 0<x<a (step S95).

In the processing at steps S93 through S95, a check is performed to determine whether or not the sampling point x has reached compression start point a. When x has not reached the compression start point a, compression of fluctuation is not required. Thus, the frequency fluctuation F(x) is set unchanged to the compressed frequency fluctuation variable F'(x).

When, at step S95, the incremented sampling point value x has not reached the compression start point a, compression is not required, program control returns to step S93 and the same processing is repeated.

When the value of the sampling point x incremented at step S95 has reached the compression start point a, a compression rate must be moderately changed from the compression start point a to the loop top b. Thus, the compression rate r(x) at the position of the sampling point x is calculated, and the compressed fluctuation F'(x) is calculated at the resultant compression rate r(x) (step S96).

In this calculation, the compression rate is gradually changed so that the compression rate is 1.0 at the compression start point a and becomes a predetermined compression rate rb at the loop top b.

Sequentially, the value of the sampling point x is incremented (step S97), and a check is performed to determine whether or not for the resultant sampling point x the relation x<b is true (step S98).

If x<b, the sampling point x has not reached the loop top and the compression rate should be gradually changed. Program control returns to step S96, and the above processing is repeated.

If the sampling point x has reached the loop top b, fluctuation to the loop end c is compressed at the predetermined compression rate rb (step S99).

The sampling point x is incremented (step S100), and a check is performed to determine whether or not the resultant point x is located within the loop top b and the loop end c (x<c) (step S101).

When the sampling point x has not yet reached the loop end, program control returns to step S99, and the above processing is repeated.

If the sampling point x has reached the loop end, the compression for fluctuation in a predetermined loop is completed. Program control thereafter returns to the main routine.

In this manner, a natural waveform can be obtained for which a frequency fluctuation compression rate is moderately changed from the compression start point a to the loop top b.

In this embodiment, the compression of the unnatural fluctuation of a repeated waveform has been explained. The present invention, however, is not limited to this, and can be applied for the compression of the unnatural fluctuation of a general tone waveform, and also for the arbitrary control of the fluctuation of a tone waveform.

As is described above in detail, according to the first tone waveform production apparatus of the present invention, a correlation coefficient for a waveform that is obtained in advance by cross-fading and a corresponding portion of the original waveform is acquired, and highly correlative waveforms are selected. Therefore, a repeated waveform of a high quality that is similar to the original waveform can be obtained, the flow of musical tones is natural, and the occurrence of unwanted higher harmonic tones and beats can be prevented. In addition, since a repeated waveform can be automatically produced, the formation of a waveform is easy and rapid, and various loop lengths can be easily simulated.

According to the second tone waveform production apparatus of the present invention, the unnatural fluctuation of a repeated waveform can be compressed, and as a result, a repeated waveform of a high quality is acquired from which tones that are similar to a natural musical tone can be produced. In addition, since the unnatural fluctuation of the repeated waveform can be automatically compressed, the formation of a tone waveform is easy and quick. Furthermore, when the compression rate for each element is changed, arbitrary control of fluctuation is possible.

Various modes of carrying out the invention are contemplated as being within the scope of the following claims that particularly point out and distinctly claim the subject matter regarded as the invention.

What is claimed is:

1. A method, for forming a repeated waveform that is employed for an electronic musical instrument, comprising the steps of:

setting, as basic data, a loop top address, an initial value of a loop length, and a length change range:

forming an original waveform;

changing said loop length within said length change range;

forming repeated waveforms that are obtained after cross-fading is performed with respect to the original waveform in consonance with the changing loop length;

acquiring correlation coefficients of said repeated waveforms, which are obtained by cross-fading, and waveforms at corresponding portions of the original waveform; and selecting a predetermined number of waveforms beginning at a waveform that is most correlative with respect to the original waveform to determine a repeated waveform.

2. An apparatus, for forming a repeated waveform that is used for an electronic musical instrument, comprising:

means for forming an original waveform;

an address calculator for obtaining as basic data, a loop top address, an initial value of a loop length, and a length change range for calculating addresses of repeated waveforms that are to be produced in consonance with changes in loop length within said length change range;

a loop processor for forming repeated waveforms obtained after cross-fading in consonance with an output of said address calculator;

a correlation coefficient calculator for calculating correlation coefficients for said repeated waveforms, which are produced by said loop processor, and waveforms at corresponding portions of the original waveform;

a peak detector for detecting a peak of said correlation coefficients that are obtained by said correlation coefficient calculator;

a selector for employing an output from said peak detector to select a predetermined number of waveforms beginning at that waveform that is most correlative with respect to the original waveform; and a display device for displaying a result of a selection by said selector.

3. A method, for forming a synthesized waveform that is used for an electronic musical instrument, said method comprising the steps of:

providing an original waveform;

dividing said original waveform into band elements for which amplitude and frequency fluctuation is to be compressed and band elements for which such fluctuation is not to be compressed;

analyzing said band elements for which said fluctuation is to be compressed to obtain harmonic elements;

extracting amplitude elements and frequency elements from said harmonic elements so obtained;

compressing fluctuation of said amplitude elements and of said frequency elements so extracted;

synthesizing waveform elements that are obtained by compression to produce new harmonic elements; and combining the new harmonic elements with the band elements for which fluctuations were not compressed to produce a synthesized waveform.

4. An apparatus, for forming a synthesized waveform from an original waveform, said apparatus being used for an electronic musical instrument and comprising:

band element dividers for dividing said original waveform into band elements for which amplitude and frequency fluctuation is to be compressed and band elements for which such fluctuation is not to be compressed and for obtaining harmonic elements in said band elements for which said fluctuation is to be compressed;

amplitude element extractors for extracting amplitude elements from said harmonic elements that are obtained by said band element dividers;

frequency element extractors for extracting frequency elements from said harmonic elements that are obtained by said band element dividers;

amplitude element fluctuation compressors for compressing fluctuation of said amplitude elements that are extracted by said amplitude element extractors;

frequency element fluctuation compressors for compressing fluctuations of said frequency elements that are extracted by said frequency element extractors;

harmonic element synthesizers for synthesizing outputs of said amplitude element fluctuation compressors and outputs of said frequency element fluctuation compressors to produce new harmonic elements; and a band element adder for adding said new harmonic elements that are obtained by said harmonic element synthesizers to said band elements for which fluctuations were not compressed, said addition producing the synthesized waveform.

* * * * *